US006477740B1

(12) United States Patent
Hansen

(10) Patent No.: US 6,477,740 B1
(45) Date of Patent: Nov. 12, 2002

(54) STRETCH BREAKING OF FIBERS

(75) Inventor: Niel W. Hansen, Salt Lake City, UT (US)

(73) Assignee: Hexcel Corporation, Dublin, CA (US)

( * ) Notice: Subject to any disclaimer, the term of this patent is extended or adjusted under 35 U.S.C. 154(b) by 0 days.

(21) Appl. No.: 10/022,129

(22) Filed: Dec. 12, 2001

(51) Int. Cl.[7] ..... D01G 1/00
(52) U.S. Cl. ..... 19/0.35; 19/0.3
(58) Field of Search ..... 19/0.35, 0.3, 0.37, 19/0.39, 0.46, 0.56, 0.6, 65 A, 65 R, 65 T, 236, 150; 156/180; 428/113, 359; 264/103, 140, 148; 57/206, 252, 257, 258, 2, 207

(56) References Cited

U.S. PATENT DOCUMENTS 2,649,623 A * 8/1953 Ingham, Jr. ..... 19/0.37
4,505,100 A * 3/1985 Yoshiyuki et al. ..... 57/207
4,547,933 A * 10/1985 Lauterbach ..... 19/0.35
4,583,266 A * 4/1986 Tango et al. ..... 19/0.37
4,759,985 A 7/1988 Armiger et al. ..... 428/367
4,825,635 A 5/1989 Guevel et al. ..... 57/315
4,837,117 A 6/1989 Armiger et al. ..... 428/392
4,856,146 A 8/1989 Armiger et al. ..... 19/0.35
4,856,147 A 8/1989 Armiger et al. ..... 19/0.35
4,857,385 A 8/1989 Armiger et al. ..... 428/189
4,863,780 A 9/1989 Armiger et al. ..... 428/189
5,006,294 A * 4/1991 Bice et al. ..... 156/180
5,045,388 A * 9/1991 Bice et al. ..... 428/113

OTHER PUBLICATIONS

Trottein, Y. et al., "Reflections on stretch–breaking of chemical filament tow," Chemical Fibers International (CFI) vol. 46, 212, 214 (1996).
Russell, JD, "Physical and Mechanical Properties of Courtaulds' Filmix Fabric," 36th International SAMPE Symposium (Apr. 1991).
"Oxidized Polyacrylonitrile (Pan)–Based Fibers," High Performance Textiles, 7–8 (Nov. 1990).
Russell, JD, "Comparison of Processing Techniques for Filmix™ Unidirectional Commingled Fabric," 35th International SAMPE Symposium (Apr. 1990).
"Carbon Fibers—A Major Development," OE Report, 4:6–7 (May/Jun. 1980).

* cited by examiner

*Primary Examiner*—Gary L. Welch
(74) *Attorney, Agent, or Firm*—Shapiro & Dupont LLP

(57) ABSTRACT

An apparatus and method for stretch breaking fibers wherein the formation of relatively small (lengths less than 30 microns) fractured fibers is substantially reduced. This reduction is achieved by applying a dampening fluid to the bundle of fibers during stretch breaking to dampen shockwaves generated during the fracturing process. The fractured fiber bundle may be subsequently treated with a sizing material to improve bundle cohesiveness and handling characteristics.

24 Claims, 1 Drawing Sheet

STRETCH BREAKING OF FIBERS

BACKGROUND OF THE INVENTION

1. Field of the Invention

The present invention relates generally to methods and apparatus for stretch breaking fibers. More particularly, the present invention involves stretching and breaking bundles of relatively brittle fibers using methods and apparatus that reduce the amount of small fiber filaments which are produced during the stretch breaking process.

2. Description of Related Art

Composite materials are well known and widely used in applications where a high strength and light weight material is required. Composite materials are typically composed of fibers that are embedded in a polymer resin matrix. Glass and carbon are two of the most popular fiber materials. Epoxy and phenolic resins are two of the most popular resin matrix materials. The fibers used in composite materials can be arranged in a wide variety of configurations depending upon the desired final properties of the composite. For example, fibers can be randomly oriented in the resin matrix or they can be woven into a wide variety of fabric patterns.

In many applications, multiple fibers are combined to form yarn that is woven to form fabric which is impregnated with resin and cured to form the final composite. In many situations, it is desirable to use yarn which contains continuous unbroken fibers. However, there are a number of situations where yarn containing broken fibers or filaments are desirable. For instance, yarn containing discontinuous fibers is useful in situations where the composite material is formed into complex shapes. Fabric made from yarn containing discontinuous fibers is easier to form around tight bends than fabric made using continuous fibers.

A common method for forming yarn with discontinuous fibers is referred to as "stretch breaking". Typical stretch breaking methods involve coating a fiber bundle with various viscous lubricants and stretching the bundle until the individual fibers break or fracture into multiple fragments. In some methods, the fiber bundle is subjected to breaker bars during stretching to facilitate fracturing of the fibers. The resulting fractured yarn is used in the same manner as unbroken yarn except that it must be handled more carefully to prevent the yarn from falling apart. The viscous lubricant is designed, among other things, to help keep the bundle of fractured fiber together. Exemplary stretch breaking methods are described in U.S. Pat. Nos. 4,759,985 and 4,825,635.

Although the existing methods for stretch breaking fibers are well suited for their intended purpose, there is a continuing need to improve upon such methods. For example, many of the stretch break methods produce a large number of relatively short (ie. less than 30 microns long) fiber fragments. The generation of a relatively large number of short fiber fragments reduces the strength of the final composite material. In addition, the short fibers tend to separate out from the fractured bundle during stretching and during subsequent handling. This not only causes potential pollution problems, but also results in loss of mass from the yarn. Further, the amount of viscous lubricants used to coat the fibers must be carefully controlled. In most applications, the amount of lubricant is kept below one percent by weight of the total yarn bundle weight. If too much lubricant is used, the adhesion of the fractured fibers to the resin matrix can be adversely affected. If too little lubricant is used, the broken bundle will lack the desired cohesiveness and may not be further processed (i.e., the bundle falls apart).

SUMMARY OF THE INVENTION

In accordance with the present invention, a method and apparatus are provided for stretch breaking fibers wherein the formation of relatively short filaments is reduced and the need for viscous lubricants is eliminated. The present invention is based upon the discovery that the shock waves generated during fracturing of stretched fibers cause the formation of a high proportion of relatively short (i.e., less than 30 microns long) filaments. It was discovered that the application of a sufficient amount of dampening fluid, such as water, to the stretched fiber bundle provides sufficient dampening of the shock waves to reduce the amount of relatively short filaments which are formed.

The present invention also includes the addition of compatible coatings to the stretch broken bundles to increase bundle cohesiveness and ensure bundle integrity as they are handled subsequent to stretch breaking.

One aspect of the present invention involves apparatus for stretch breaking fibers to provide bundles of fractured filaments having different lengths. The apparatus includes a bundle anchoring device which anchors the bundle or "tow" of fibers at a first end of the bundle. The apparatus further includes a bundle pulling device which pulls on the bundle of fibers at a second end to produce a stretched bundle extending between the first and second ends of the bundle. The amount of stretching provided by the bundle pulling device is sufficient to break the fibers to form fractured filaments having different lengths. The apparatus further includes a fluid applicator which applies a dampening fluid to the bundle of fibers. A sufficient amount of dampening fluid is applied to the bundle in order to provide dampening of the shock waves generated along substantially the entire length of the stretched bundle. It was discovered that saturating substantially the entire length of the stretched bundle of fibers provides sufficient dampening of the shock waves to reduce the amount of relatively short fiber filaments formed during fracturing of the fibers.

As a feature of the present invention, water is a preferred dampening fluid, because it is extremely inexpensive and can be removed easily by evaporation. Further, it was discovered that the tendency of the stretch-broken tows or yarn to fall apart could be reduced by leaving a small amount of water in the fiber bundle. The damp fractured bundle is then treated with compatible coatings or sizing materials to increase the cohesiveness of the bundle sufficiently so that the integrity of the bundle is not compromised during subsequent handling.

Another aspect of the present invention involves methods for stretch breaking fibers to provide bundles of fractured filaments having different lengths. The method includes the step of anchoring a bundle of fibers at a first end with an anchoring device, such as a pair of rollers. In a second step, a pulling device, such as a pair of rollers, is provided for pulling on the bundle of fibers to provide sufficient stretching to fracture the fibers to form filaments having different lengths. As a feature of the invention, the method includes applying a sufficient amount of a dampening fluid to the stretched bundle of fibers to provide dampening of the shock waves along substantially the entire length of the stretched bundle. In a final step of the method, the dampening fluid is removed from the bundle after formation of the fractured filaments and/or a compatible coating is applied to increase the cohesiveness of the bundle to provide a stable product which can be processed further without falling apart.

The present invention is also directed to the bundles of stretch-broken fibers formed using the above-summarized apparatus and method. In addition, the invention covers the textiles and composite materials that include bundles of stretch-broken fibers as described above.

The present invention is an improvement over existing methods and apparatus in that stretch breaking of fibers is provided wherein the number of relatively short fractured filaments is reduced and wherein the resulting fractured fiber bundles are free of viscous lubricants.

The above discussed and many other features and attendant advantages of the present invention will become better understood by reference to the following detailed description when taken in conjunction with the accompanying drawings.

DETAILED DESCRIPTION OF THE INVENTION

Figure 1:
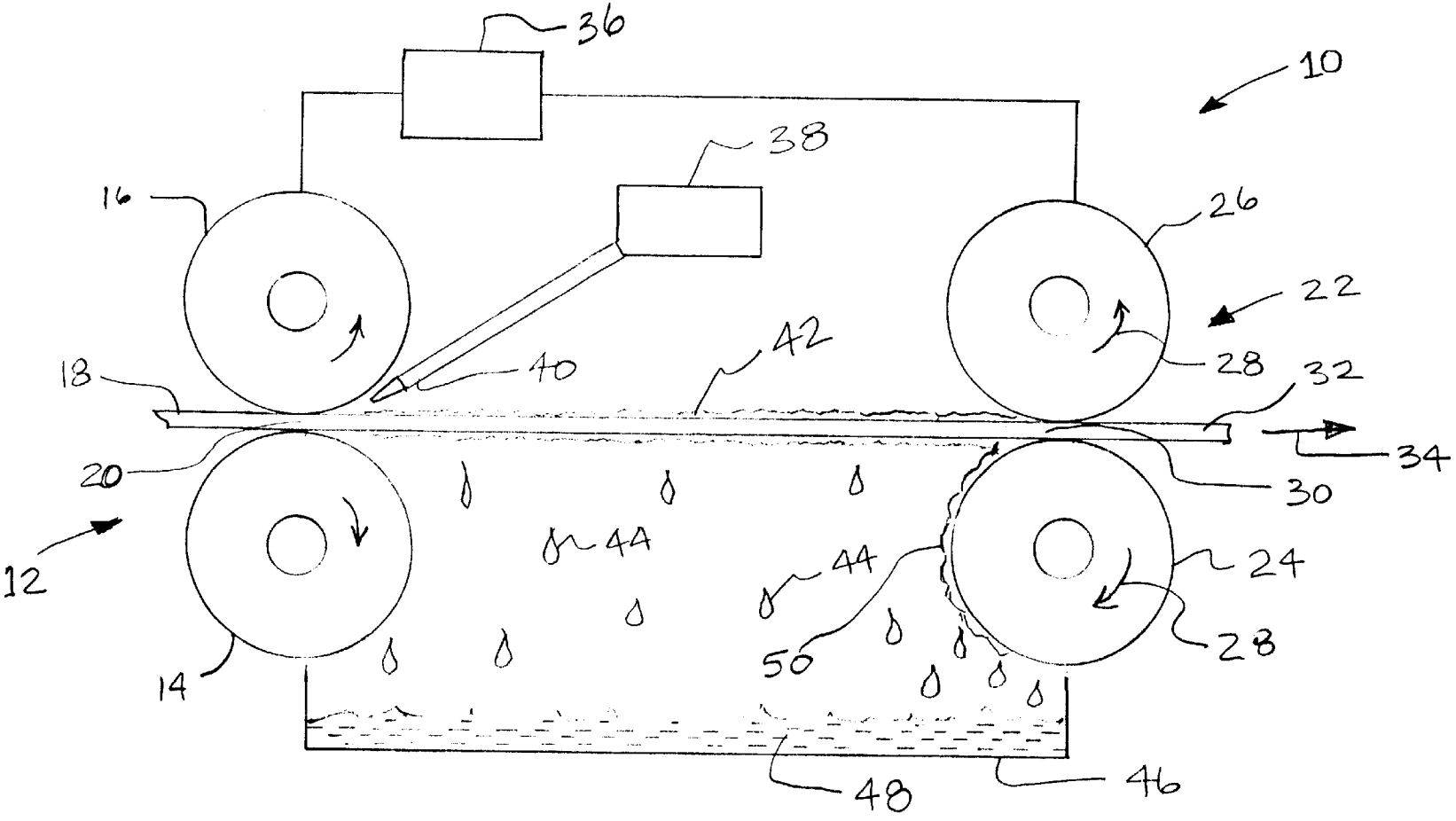
FIG. 1 is a diagrammatic representation of an apparatus for stretch breaking fibers in accordance with the present invention.

The present invention provides methods and apparatus for stretch breaking a wide variety of fibers. The types of fibers which may be stretch broken include glass fibers, carbon fibers, silicon carbide and other ceramic fibers. Preferred fibers are those which are relatively brittle. Such fibers typically will fracture when they are stretched to 3 percent elongation or less. Exemplary fibers are high modulus fibers which have a modulus of about 30 Msi or more. Carbon fibers having a modulus of between about 30 and 50 Msi are particularly preferred. The individual fibers may range in diameter from 3 to 10 microns. Bundle sizes which are amenable to treatment include those bundles, tows or yarn bundles which contain from 3,000 to 50,000 individual filaments or fibers in each bundle. In general, the present invention may be used in stretch breaking of any fiber bundles which are presently being stretch broken utilizing the known procedures as described in previously-mentioned U.S. Pat. Nos. 4,759,985 and 4,825,635.

An apparatus in accordance with the present invention is shown generally at 10 in FIG. 1. The apparatus is designed for stretch breaking of fibers to provide bundles of fractured filaments having different lengths. The apparatus 10 includes a bundle anchoring device shown generally at 12. The bundle anchoring device includes a pair of rollers 14 and 16 which are pressed against the bundle of fibers 18 to provide anchoring thereof. The use of rollers 14 and 16 to anchor the bundle at the first end of the bundle 20 is well known in the art. Other types of anchoring devices may be used if desired.

The stretch breaking apparatus 10 further includes a bundle pulling device shown generally at 22. The bundle pulling device 22 preferably includes a pair of rollers 24 and 26 which are pressed against bundle 18 and rotated as shown by arrows 28 to provide pulling of the bundle 18. As is known in the art, the pair of pulling rollers 24 and 26 are rotated slightly faster than the anchoring rollers 14 and 16 to provide desired stretching of the bundle 18 between the bundle first end 20 and the bundle second end 30. The amount of stretching is carefully controlled depending on the particular type of fiber being stretch broken. The amount of stretching is selected to provide a bundle of fractured filaments 32 having different lengths. The stretch broken bundle exits the apparatus at 10 in the direction as shown by arrow 34. Typically, a control device 36 is provided for controlling the relative rotational speeds of rollers 14/16 and 24/26 to ensure accurate and reproducible stretching of the fibers to the point where fracturing occurs.

The temperature at which fracturing is carried out is not critical. For most operations, room temperature is suitable. Temperatures may be varied, if desired, depending upon the particular dampening fluid being used.

In accordance with the present invention, it was discovered that shockwaves are generated during breakage of fibers. These shockwaves were found to be responsible for the generation of a relatively large number of small (less than 30 microns in length) fiber fragments. These fiber fragments are undesirable in that they tend to fall from the stretched fiber bundle resulting in reduction in bundle mass and strength. Further, the small fibers tend to become airborne and must be captured and removed in order to prevent possible pollution problems.

The shockwaves generated during breakage are dampened utilizing a dampening fluid. The dampening fluid is contained in a reservoir 38. The dampening fluid is preferably applied to the bundle 18 utilizing one or more nozzles 40. The nozzle(s) is preferably located so that dampening fluid is applied at the first end 20 of bundle 18. As the bundle moves between the rollers in the direction of arrow 34, the bundle 18 becomes completely saturated with dampening fluid as shown at 42. The amount of dampening fluid 42 which is applied through nozzle(s) 40 is sufficient to completely saturate the bundle 18 over substantially the entire distance between the anchoring rollers 14/16 and pulling rollers 24/26. To ensure that sufficient dampening fluid is present to dampen out the shockwaves, it is preferred that the amount of dampening fluid be sufficient so that dampening fluid drops from bundle 18 as represented by droplets 44. The droplets of dampening fluid 44 are recovered in a container 46. The recovered dampening fluid 48 may be recycled to reservoir 38 or discarded. The term "substantially the entire distance" means at least 90% of the distance between the location where the bundle 18 is anchored by the anchoring rollers 14/16 and the location where the bundle 18 is stretched by pulling rollers 24/26 (i.e., 90 percent of the length of the stretched bundle). More preferably, "substantially the entire distance" means at least 95% of the length of the bundle being stretched.

The pulling rollers 24 and 26 are thrust against bundle 18 with sufficient pressure to not only provide sufficient traction to pull the fiber bundle 18, but also to squeeze or wring excess dampening fluid from the bundle as shown at 50. It is possible to squeeze substantially all of the dampening fluid from bundle 18, to produce a stretched bundle 32 containing little if any dampening fluid. However, it is preferable to squeeze only a portion of the dampening fluid from the bundle to produce a stretched bundle 32 having a residual amount of dampening fluid left therein.

Water is a preferred dampening fluid. Water was found to provide adequate dampening of the stretched fiber to substantially reduce the shockwaves generated during fiber fracture. In addition, water is easily removed from the stretched fiber bundle by evaporation. Preferably, deionized or reverse osmosis water is utilized wherein impurities in the water are reduced. Use of such purified water ensures that no contaminants are introduced into the fiber bundle 18 which might adversely affect surface properties of the final bundle. However, in many situations untreated tap water may be used with acceptable results.

In accordance with the present invention, it was discovered that structural integrity of the stretch bundle 32 is optimized by leaving between 10 to 20 weight percent of water in the bundle. Preferably, the amount of water remaining in the bundle after it is passed through rollers 24 and 26 is about 15 percent. This amount of water was found to provide some cohesiveness for the fractured fiber bundle 32 so that it is more easily handled.

Suitable dampening fluids in addition to water are organic and inorganic fluids which are capable of dampening shock waves. In general, a suitable dampening fluid is one which is capable of dampening shockwaves generated during fiber pulling and which can be easily removed from the fiber bundle without adversely affecting the physical or chemical properties of the final fiber bundle. If desired, the dampening fluid may contain certain additives which are intended as a coating or surface treatment for a particular application or use of the final stretched fiber bundle.

The apparatus and methods of the present invention have been shown with the dampening fluid being applied only at the first end of the fiber bundle. It will be understood by those skilled in the art that any method for applying the dampening fluid to the fiber bundle is suitable provided that the fiber bundle is completely saturated along substantially its entire length between the anchoring rollers 14/16 and pulling rollers 24/26. For example, multiple application nozzles located along the entire length of stretched fiber bundle may be used. Alternatively, the entire fiber bundle may be immersed in a reservoir of dampening fluid. For simplicity, however, it was found that sufficient dampening fluid could be applied using a single nozzle applying a sufficient amount of dampening fluid so that the fiber bundle becomes completely saturated along its entire length between the two pairs of rollers as the bundle travels through the apparatus.

As known in the art, the stretched fiber bundle may be manipulated with breaker bars (not shown) which are designed to facilitate fracturing of the fibers. A wide variety of breaker bar configurations are possible ranging from simple bar structures that hit the fibers to more complex structures which manipulate the fibers so as to provide desired levels of fiber fracturing. In accordance with the present invention, it was discovered that the use of dampening fluid produces fractured fiber bundles which are substantially free of fractured filaments that are less than 30 microns long. "Substantially free" means about 1 percent or less.

The damp stretch broken fiber bundle 32 can be handled to some degree without affecting integrity. However, upon drying, the fractured bundle is more difficult to handle. Accordingly, it is preferred to treat the damp fractured bundle with a sizing material that is compatible with the dampening fluid and which increases the cohesiveness of the fiber bundle. For example, water-based epoxies are a preferred coating or sizing material when water is used as the dampening fluid. Other coatings that are commonly used as sizing materials may be used. The sizing material is preferably applied as a mist or fine spray. The amount of sizing added is between about 0.3 weight percent to about 3.0 weight percent. Amounts in the range of about 0.5 to 1.5 weight percent are preferred. In general, the amount of sizing applied to the bundle will be sufficient to increase the cohesiveness of the bundle so that it can be handled without falling apart while at the same time not saturating the bundle.

The coated or "sized" fiber bundle may be dried and then wound onto a spool or otherwise further processed. For example, as is well known, the sized fiber bundles can be woven to form any number of desired fabric structures. The fabric structures are impregnated with a suitable polymer resin such as epoxy resin, phenolic resin, biomaleimides (BMI), vinyl esters and polyesters, and other thermosetting and thermoplastic resins. The sized fiber bundle may be used in the same manner as previous stretch broken fiber bundles to form a wide variety of composite materials where the stretch broken fibers are embedded in a resin matrix. The stretch broken fibers are especially useful in forming complex composite material structures which include relatively sharp bends.

Having thus described exemplary embodiments of the present invention, it should be noted by those skilled in the art that the within disclosures are exemplary only and that various other alternatives, adaptations and modifications may be made within the scope of the present invention. Accordingly, the present invention is not limited to the above preferred embodiments and examples, but is only limited by the following claims.

What is claimed is:

1. An apparatus for stretch breaking fibers to provide bundles of fractured filaments having differing lengths, said apparatus comprising:

a bundle anchoring device which anchors a bundle of fibers at a first end of said bundle;

a bundle pulling device which pulls on said bundle of fibers at a second end to provide a stretched bundle extending between said first and second ends of said bundle wherein said fibers in said stretched bundle break to form fractured filaments having differing lengths and wherein shock waves are generated during the breaking of said fibers; and a fluid applicator which applies a dampening fluid to said bundle of fibers wherein a sufficient amount of dampening fluid is applied to said bundle to provide dampening of said shock waves along substantially the entire length of said stretched bundle.

2. An apparatus for stretch breaking fibers according to claim 1 wherein said bundle anchoring device comprises a pair of anchoring rollers between which said bundle of fibers is anchored and wherein said bundle pulling device is a pair of pulling rollers between which said bundle of fibers are located, said pairs of anchoring rollers and pulling rollers providing continual passage of said fiber bundle therebetween.

3. An apparatus for stretch breaking fibers according to claim 2 wherein said fluid applicator comprises a nozzle located adjacent to said anchoring rollers to provide application of said dampening fluid at the first end of said bundle and wherein said pulling rollers are located such that at least a portion of said dampening fluid is squeezed from said bundle as said bundle passes between said pulling rollers.

4. An apparatus for stretch breaking fibers according to claim 1 wherein said dampening fluid comprises water.

5. An apparatus for stretch breaking fibers according to claim 1 wherein a container is provided for receiving excess dampening fluid which may fall from said stretched bundle.

6. A method for stretch breaking fibers to provide bundles of fractured filaments having differing lengths, said method comprising the steps of:

anchoring a bundle of fibers at a first end of said bundle with an anchoring device;

pulling on said bundle of fibers at a second end using a pulling device to provide a stretched bundle extending between said first and second ends of said bundle wherein said fibers in said stretched bundle are broken to form fractured filaments having differing lengths and wherein shock waves are generated during the breaking of said fibers; and applying a sufficient amount of a dampening fluid to said bundle of fibers to provide dampening of said shock waves along substantially the entire length of said stretched bundle; and removing said dampening fluid from said bundle after formation of said fractured filaments.

7. A method for stretch breaking fibers according to claim 6 wherein said fibers are selected from the group consisting of carbon, ceramic and glass.

8. A bundle of stretch broken fibers comprising fractured filaments of different lengths, said bundle of stretch broken fibers being made according to the method of claim 7.

9. A method for stretch breaking fibers according to claim 6 wherein said dampening fluid comprises water.

10. A bundle of stretch broken fibers comprising fractured filaments of different lengths, said bundle of stretch broken fibers being made according to the method of claim 9.

11. A method for stretch breaking fibers according to claim 6 wherein said anchoring device comprises a pair of anchoring rollers between which said bundle of fibers is anchored and wherein said bundle pulling device is a pair of pulling rollers between which said bundle of fibers are located, said pairs of anchoring rollers and pulling rollers providing continual passage of said fiber bundle therebetween.

12. A method for stretch breaking fibers according to claim 11 wherein said dampening fluid is applied using a fluid applicator comprising a nozzle located adjacent to said anchoring rollers to provide application of said dampening fluid at the first end of said bundle and wherein said pulling rollers are located such that at least a portion of said dampening fluid is squeezed from said bundle as said bundle passes between said pulling rollers.

13. A method for stretch breaking fibers according to claim 6 which includes the step of applying a sizing material to said fractured filaments.

14. A bundle of stretch broken fibers comprising fractured filaments of different lengths, said bundle of stretch broken fibers being made according to the method of claim 13.

15. A composite material comprising at least one bundle of stretch broken fibers in accordance with claim 14 and a resin matrix.

16. A bundle of stretch broken fibers comprising fractured filaments of different lengths, said bundle of stretch broken fibers being made according to the method of claim 6.

17. A composite material comprising at least one bundle of stretch broken fibers in accordance with claim 16 and a resin matrix.

18. A bundle of stretch broken fibers comprising fractured filaments of different lengths wherein said bundle comprises one weight percent or less of fractured filaments having lengths less than 30 microns.

19. A bundle of stretch broken fibers according to claim 18 which further includes from about 0.3 to about 3.0 weight percent of a sizing material.

20. A composite material comprising at least one bundle of stretch broken fibers in accordance with claim 18 and a resin matrix.

21. A bundle of stretch broken fibers comprising fractured filaments of different lengths and a dampening fluid wherein the amount of dampening fluid in said bundle of stretch broken fibers is between 10 and 20 weight percent.

22. A bundle of stretch broken fibers according to claim 21 wherein said dampening fluid comprises water.

23. A bundle of stretch broken fibers according to claim 21 wherein the amount of dampening fluid in said bundle of stretch broken fibers is about 15 weight percent.

24. A bundle of stretch broken fibers according to claim 23 wherein said dampening fluid comprises water.

* * * * *